US010086610B2

(12) United States Patent
Miyazawa

(10) Patent No.: US 10,086,610 B2
(45) Date of Patent: Oct. 2, 2018

(54) INKJET HEAD AND METHOD OF MANUFACTURING INKJET HEAD

(71) Applicant: TOSHIBA TEC KABUSHIKI KAISHA, Tokyo (JP)

(72) Inventor: Toshio Miyazawa, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/694,926

(22) Filed: Sep. 4, 2017

(65) Prior Publication Data

US 2018/0072058 A1 Mar. 15, 2018

(30) Foreign Application Priority Data

Sep. 15, 2016 (JP) ..... 2016-180343

(51) Int. Cl.

| | |
|---|---|
| ***B41J 2/05*** | (2006.01) |
| ***B41J 2/045*** | (2006.01) |
| ***B41J 2/14*** | (2006.01) |
| *B41J 2/165* | (2006.01) |

(52) U.S. Cl.

CPC ..... *B41J 2/14201* (2013.01); *B41J 2/04533* (2013.01); *B41J 2/1404* (2013.01); *B41J 2/165* (2013.01); *B41J 2002/14306* (2013.01); *B41J 2002/16502* (2013.01); *B41J 2202/03* (2013.01); *B41J 2202/22* (2013.01)

(58) Field of Classification Search

CPC ..... B41J 2/04533; B41J 2/165; B41J 2/1404; B41J 2/14201

USPC ..... 347/54, 63, 65, 68

See application file for complete search history.

(56) References Cited

U.S. PATENT DOCUMENTS

| | | | | |
|---|---|---|---|---|
| 8,714,715 | B2 | 5/2014 | Koseki | |
| 9,302,480 | B2 * | 4/2016 | Enomoto | B41J 2/14201 |
| 9,630,406 | B2 * | 4/2017 | Fukaya | B41J 2/14209 |

FOREIGN PATENT DOCUMENTS

| | | |
|---|---|---|
| JP | 2013-010211 | 1/2013 |
| JP | 2015-189031 | 11/2015 |

* cited by examiner

*Primary Examiner* — An Do

(74) *Attorney, Agent, or Firm* — Patterson & Sheridan, LLP

(57) ABSTRACT

According to one embodiment, an inkjet head includes a plurality of actuators on a substrate in a row and spaced from each other, each actuator extending from the substrate to form a chamber space between each adjacent pair of actuators in the plurality of actuators, a flow passage block including a frame portion surrounding an outer periphery of the plurality of actuators and a blocking portion having protrusions sealing both ends of the chamber spaces between every other adjacent pair of actuators along the row, and a common ink chamber above the flow passage block and in fluid communication with the chamber spaces between any adjacent pairs of actuators not sealed at both ends by the blocking portion with a plurality of chamber spaces.

20 Claims, 18 Drawing Sheets

INKJET HEAD AND METHOD OF MANUFACTURING INKJET HEAD

CROSS-REFERENCE TO RELATED APPLICATION

This application is based upon and claims the benefit of priority from Japanese Patent Application No. 2016-180343, filed Sep. 15, 2016, the entire contents of which are incorporated herein by reference.

FIELD

Embodiments described herein relate generally to an inkjet head and a method of manufacturing an inkjet head.

BACKGROUND

In an inkjet printer ejecting liquid ink from a nozzle onto a recording medium such as paper, the ink left inside the nozzle dries during prolonged waiting times between printings, clogging the nozzle. Thus, in an existing inkjet printer of this type, ink is continuously circulated between an ink tank and an inkjet head in which the nozzle is disposed.

In an inkjet head with such ink circulation system, pressure chambers made of piezoelectric materials are arranged linearly. A space sandwiched between adjacent piezoelectric materials may serve as a pressure chamber that can eject the ink via a nozzle. However, when the piezoelectric materials of a particular pressure chamber are driven at high speed, the ink may be unintendedly ejected from an adjacent pressure chamber. To address the problem, some inkjet heads are configured such that every other one of the spaces between the piezoelectric elements are hermetically sealed, thereby providing a space adjacent to each pressure chamber as a dummy chamber. In the inkjet head having dummy chambers of this type, each dummy chamber is formed by sealing a gap between the piezoelectric elements with, for example, a resin.

However, filling the gap between the piezoelectric elements with resin requires difficult work. Particularly when piezoelectric elements are arranged at short intervals or many piezoelectric elements are provided, resin filling errors increase in frequency and product yield is degraded.

DETAILED DESCRIPTION

In general, according to one embodiment, an inkjet head includes a plurality of actuators on a substrate in a row and spaced from each other, each actuator extending from the substrate to form a chamber space between each adjacent pair of actuators in the plurality of actuators, a flow passage block including a frame portion surrounding an outer periphery of the plurality of actuators and a blocking portion having protrusions sealing both ends of the chamber spaces between every other adjacent pair of actuators along the row, and a common ink chamber above the flow passage block and in fluid communication with the chamber spaces between any adjacent pairs of actuators not sealed at both ends by the blocking portion with a plurality of chamber spaces.

First Embodiment

A first embodiment will be described hereinafter with reference to the drawings. In the description below, an orthogonal coordinate system configured with an X-axis, a Y-axis, and a Z-axis orthogonal to one another is used.

Figure 1:
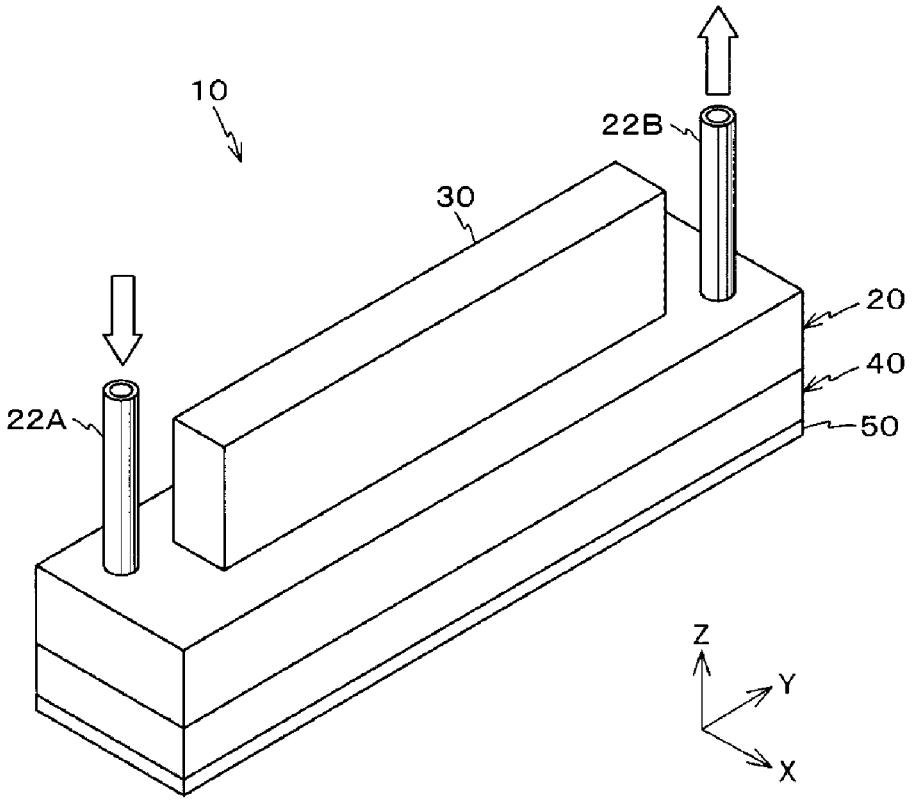
FIG. 1 is a perspective view of an inkjet head according to a first embodiment.
Figure 2:
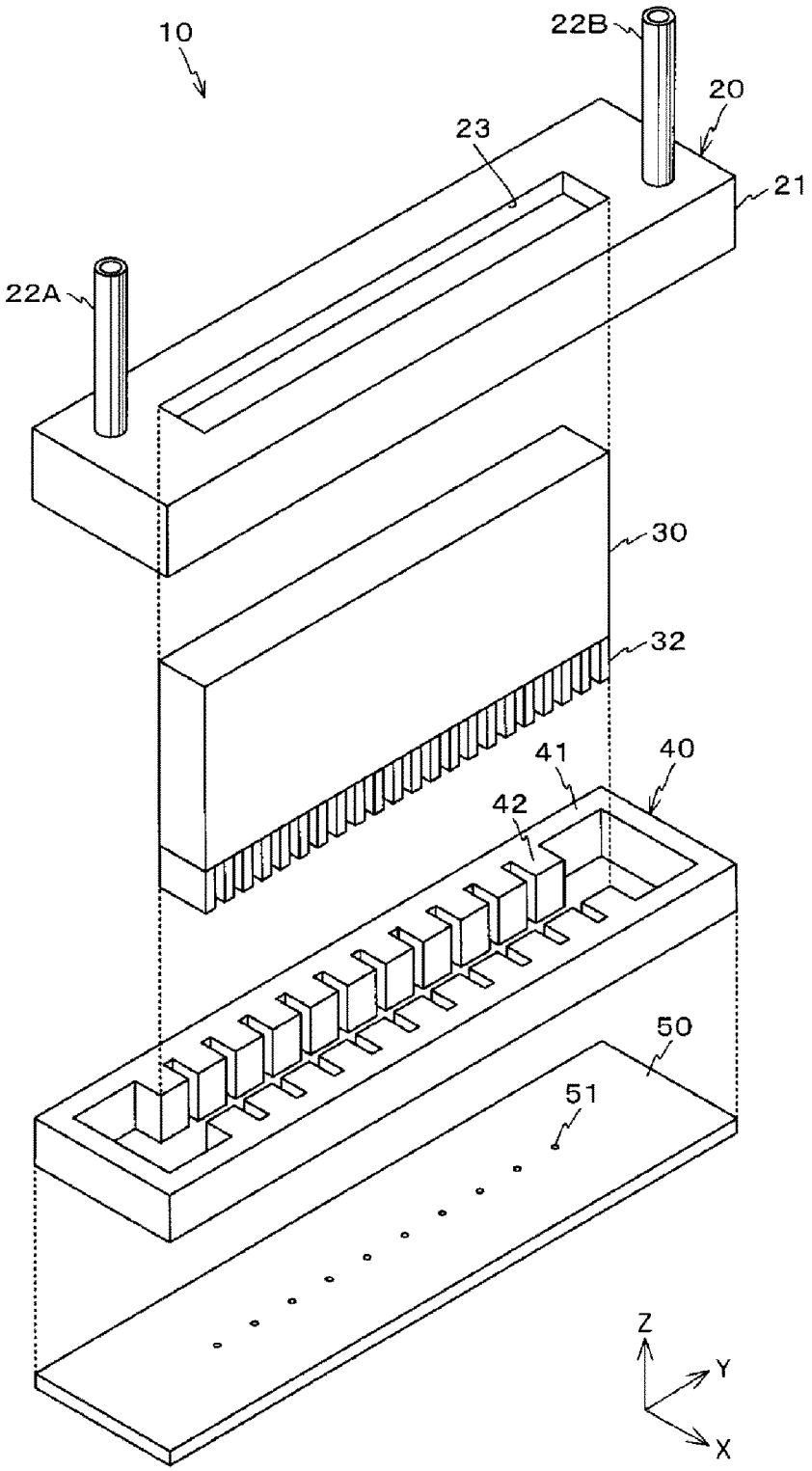
FIG. 2 is an exploded perspective view of an inkjet head according to the first embodiment.

FIG. 1 is a perspective view of an inkjet head 10 according to the first embodiment. The inkjet head 10 is a shared wall type inkjet head. FIG. 2 is an exploded perspective view of the inkjet head 10. The inkjet head 10 includes a casing 20, a substrate orifice plat, a flow passage block 40, an orifice plate 50.

Figure 3:
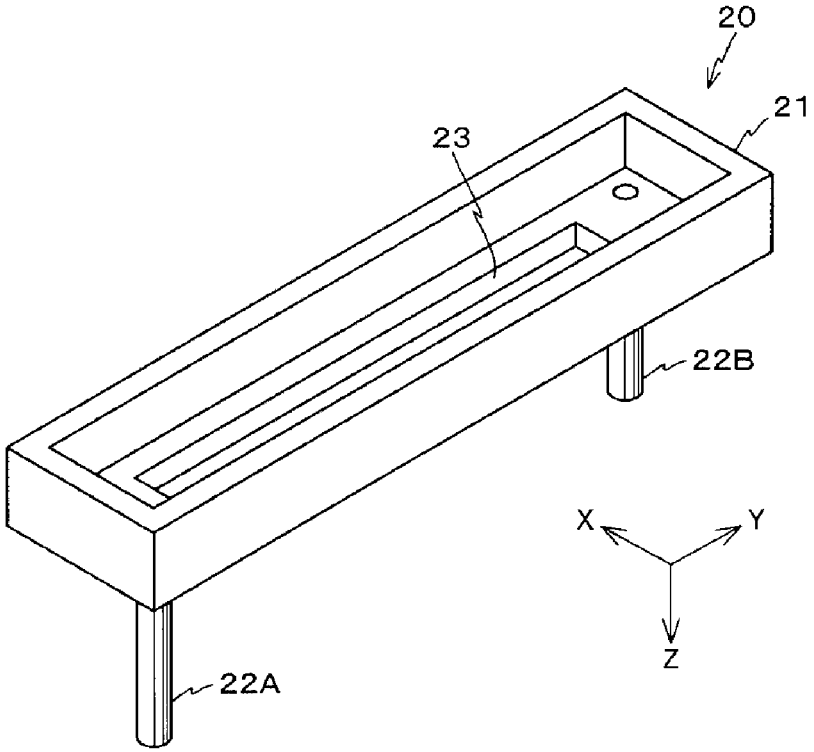
FIG. 3 is a perspective view of a casing according to the first embodiment.

As shown in FIG. 2, the casing 20 includes a casing body 21 extending in a Y-axis direction, and two ducts 22A and 22B attached to the casing body 21. FIG. 3 is a perspective view of the casing 20 viewed from below on a −Z side of a Z-axis direction. The casing body 21 has a rectangular opening 23 having a length of about 50 mm in the Y-axis direction and downward on the −Z-side. The casing body 21 is formed of, for example, metal such as aluminum or stainless steel having an insulating film formed on each surface thereof, resin such as plastic, or ceramic.

As shown in FIG. 1, the ducts 22A and 22B extends in a Z-axis direction and are secured at respective end portions in the Y-axis direction, on an upper surface of the casing 20. The ducts 22A and 22B are fluidly connected with an internal space of the casing 20. The ducts 22A and 22B constitute a circulation system for ink supplied to the inkjet head 10. The ink to be supplied to the inkjet head 10 is supplied from the duct 22A and discharged from the duct 22B. The ink thereby circulates between the inkjet head 10 and ink tanks, which are not specifically depicted.

As shown in FIG. 2, the substrate 30 has a rectangular shape extending in the Y-axis direction. A plurality of actuators 32 disposed side by side in the Y-axis direction are secured to a lower surface of the substrate 30. The substrate 30 is formed of, for example, a material having glass fibers impregnated with an epoxy resin, alumina, or ceramic. A length of the substrate 30 in the Y-axis direction is substantially equal to the length of the opening 23 in the Y-axis direction. Furthermore, a thickness of the substrate 30 is substantially equal to a thickness of the opening 23 in an X-axis direction.

Figure 4:
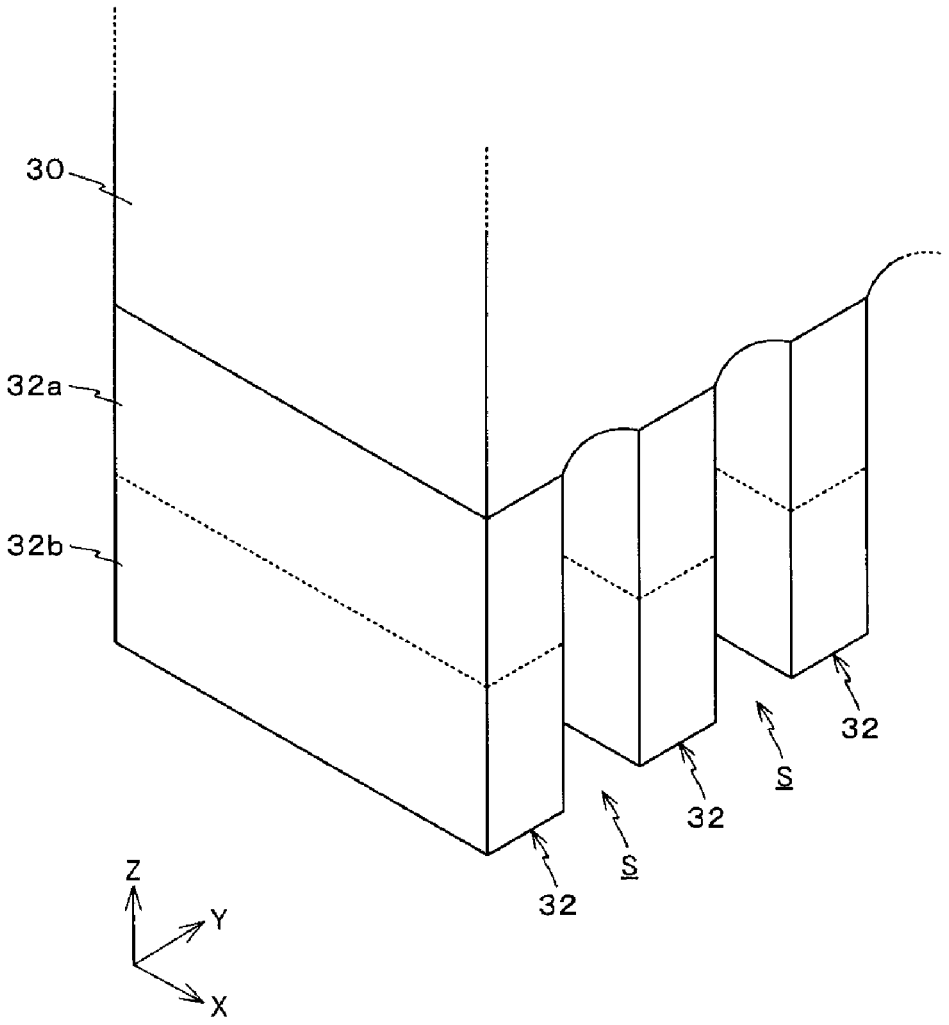
FIG. 4 is an enlarged perspective view of actuators provided on a substrate according to the first embodiment.

FIG. 4 is an enlarged view of the actuators 32 provided on the substrate 30. As shown in FIG. 4, the actuators 32 are rectangular shaped plates. Each of the actuators 32 is a stack of two piezoelectric elements 32*a* and 32*b* formed into a rectangle shape extending in the X-axis direction. A lower surface of the piezoelectric element 32*a* is bonded to an upper surface of the piezoelectric element 32*b*.

The actuators 32 are each adhesively secured to an upper surface of the piezoelectric element 32*a* to the lower surface of the substrate 30. The actuators 32 are disposed side by side along the Y-axis at equidistant intervals. Thus, spaces S sandwiched between the actuators 32 are identical to one another in size.

The piezoelectric elements 32*a* and 32*b* are, for example, piezoelectric elements primarily comprising lead zirconate titanate. A direction of polarization of the piezoelectric elements 32*a* and 32*b* is parallel to the Z-axis. A polarity of the piezoelectric element 32*a* is opposite to a polarity of the piezoelectric element 32*b*.

Figure 5:
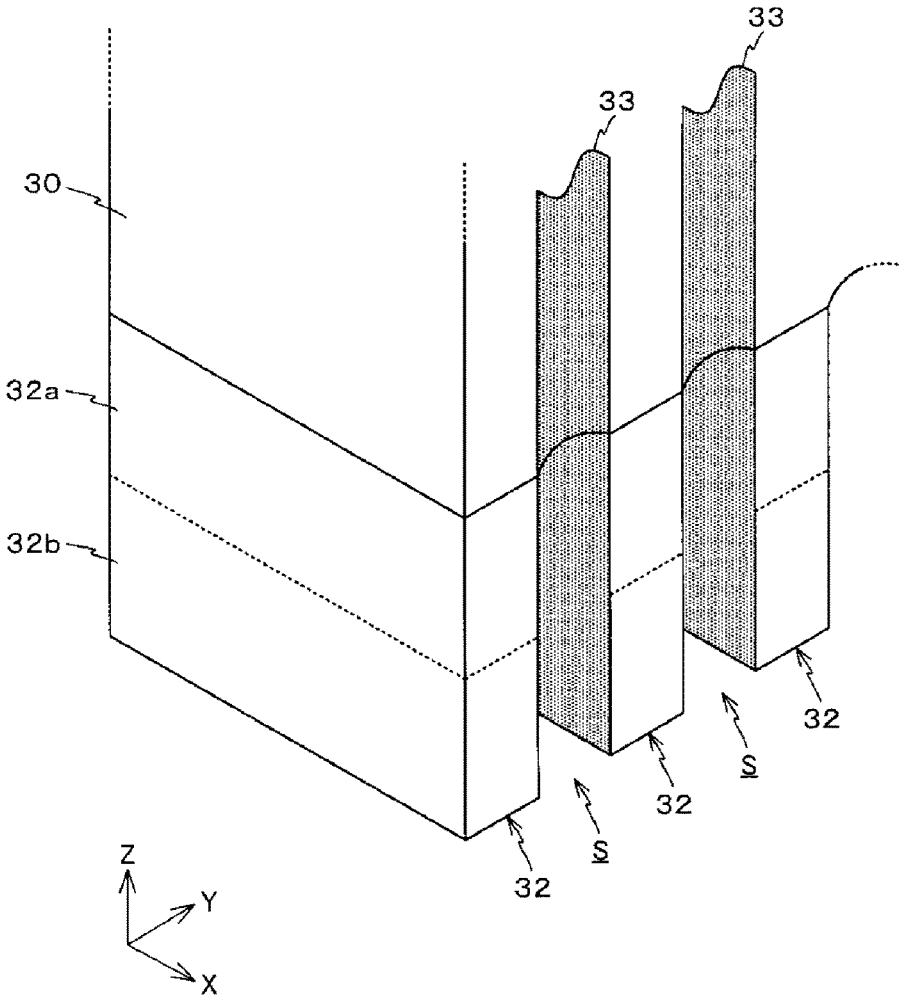
FIG. 5 is a perspective view of an electrode pattern according to the first embodiment.

As shown in FIG. 5, electrode patterns 33 are formed to connect inner wall surfaces of each space S and a +X-side surface of the substrate 30. These electrode patterns 33 are, for example, made of a nickel film and function as electrodes for applying a voltage to the actuators 32.

Figure 6:
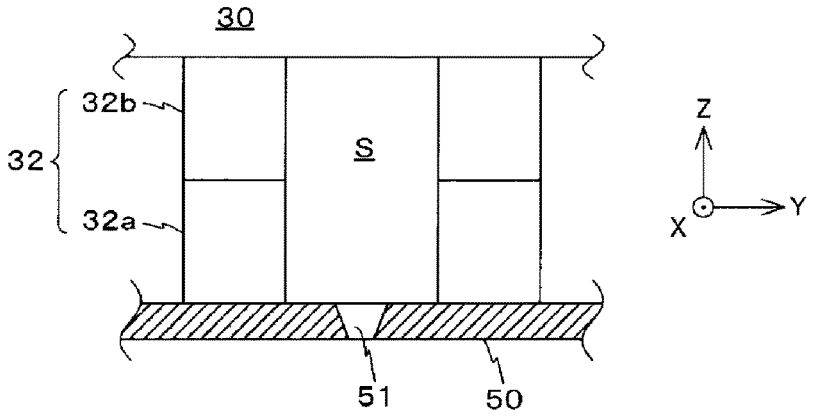
FIG. 6 is an explanatory diagram of an action of the actuators according to the first embodiment.
Figure 7:
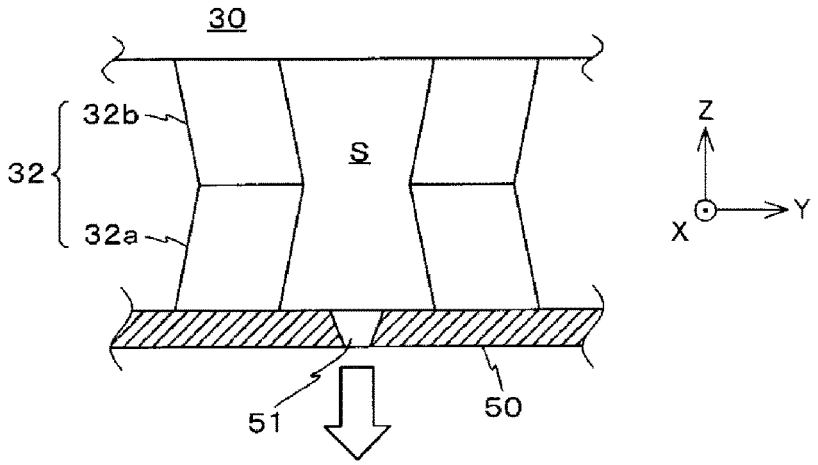
FIG. 7 is an explanatory diagram of an action performed by the actuators according to the first embodiment.

By an application of a voltage to the electrode patterns 33, the actuators 32 which are arranged linearly as shown in FIG. 6 can be deformed as shown in FIG. 7. When the actuators 32 are deformed, a volume of the space S sandwiched between the actuators 32 decreases, and the ink can be ejected via an opening 51 provided in the orifice plate 50.

As shown in FIG. 2, the flow passage block 40 extends the Y-axis direction. The flow passage block 40 includes a frame portion 41 of a rectangular frame shape and two sets of protruding portions 42 protruding inward from either inner walls of the frame portion 41. Lengths of the frame portion 41 in the X-axis direction and the Y-axis direction are equal to lengths of the casing body 21 in the X-axis direction and the Y-axis direction, respectively. The protruding portions 42 are provided inside of the frame portion 41 in such a manner that the protruding portions 42 a −X-side inner wall of the frame portion 41 face protruding portions 42 on a +X-inner side inner wall of the frame portion 41.

Figure 8:
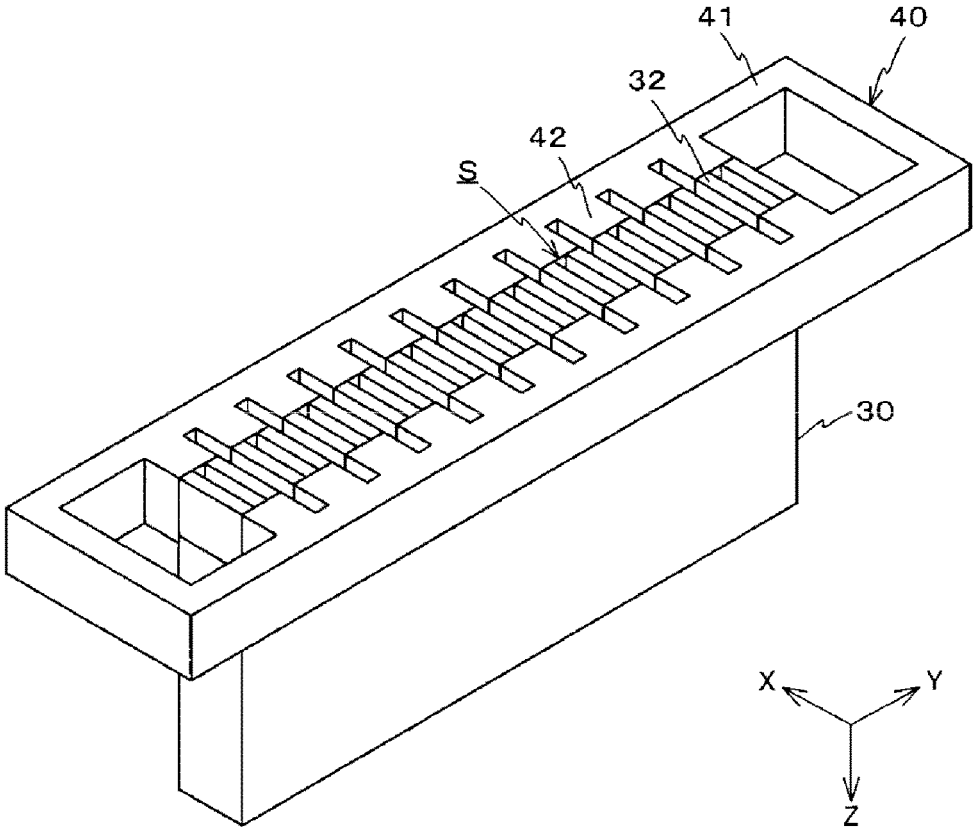
FIG. 8 is a perspective view of a flow passage block secured to the substrate and the actuators according to the first embodiment.

FIG. 8 illustrates the flow passage block 40 secured to the substrate 30 and the actuators 32. As shown in FIG. 8, when the flow passage block 40 is secured to the substrate 30 and the actuators 32, each pair of facing protruding portions 42 of the flow passage block 40 are closely attached to −X-side side surfaces and +X-side side surfaces of two actuators 32 and the substrate 30. The spaces S each sandwiched between two actuators 32 are thereby alternately blocked by a pair of facing protruding portions 42.

Figure 9:
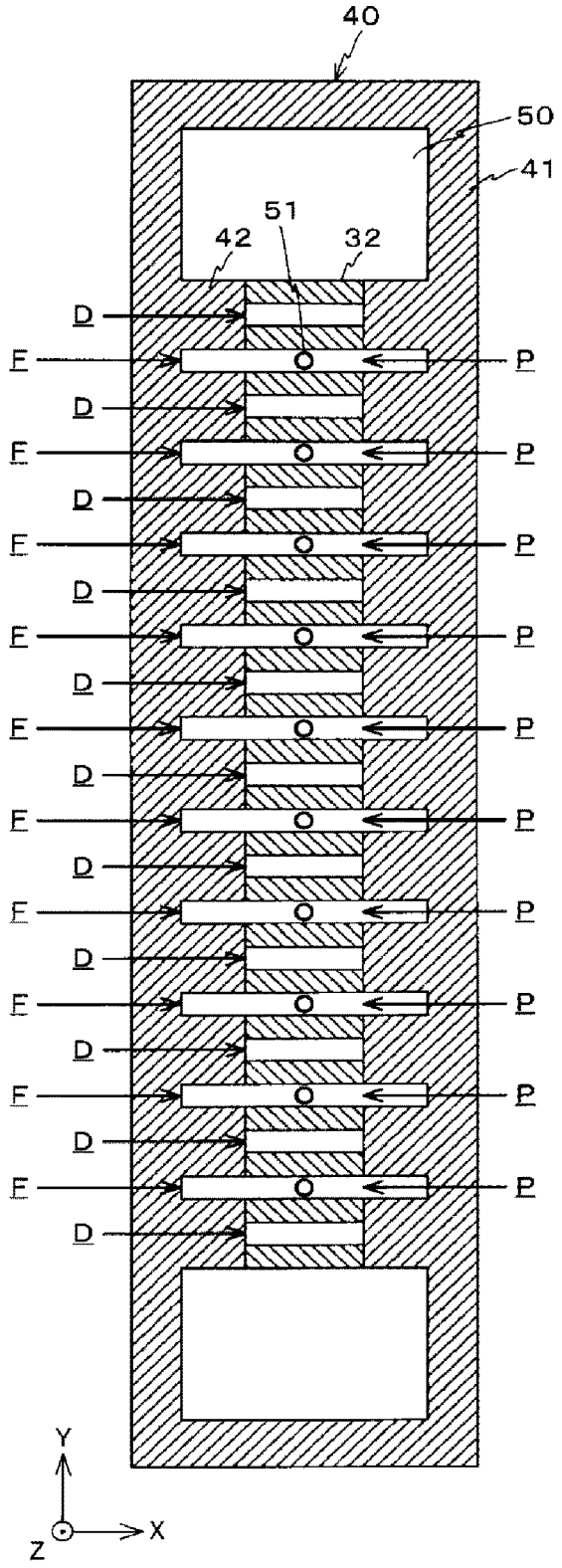
FIG. 9 is an XY cross-sectional view of an inkjet head according to the first embodiment.

As shown in FIG. 9, among the spaces S each sandwiched by two adjacent actuators 32, the spaces S blocked by the flow passage block 40 serve as dummy chambers D into which the ink does not flow. The spaces S that are not blocked by the flow passage block 40 serve as pressure chambers P into which the ink flows. The ink circulating in each pressure chamber P is supplied to the pressure chamber P through a gap between the pair of facing protruding portions 42 as a flow passage F, and then discharged for ink circulation.

As shown in FIG. 2, the orifice plate 50 is a rectangular sheet which is formed from polyimide or the like and extends in the Y-axis direction. Lengths of the orifice plate 50 in the X-axis direction and the Y-axis direction are equal to lengths of the flow passage block 40 in the X-axis direction and the Y-axis direction, respectively.

The circular openings 51 are formed in the orifice plate 50 along the Y-axis at equidistant intervals. The openings 51 function as nozzles ejecting the ink circulating in the inkjet head 10 onto a recording medium such as paper. The intervals of these openings 51 are identical to the intervals of the pressure chambers P shown in FIG. 9.

Figure 10:
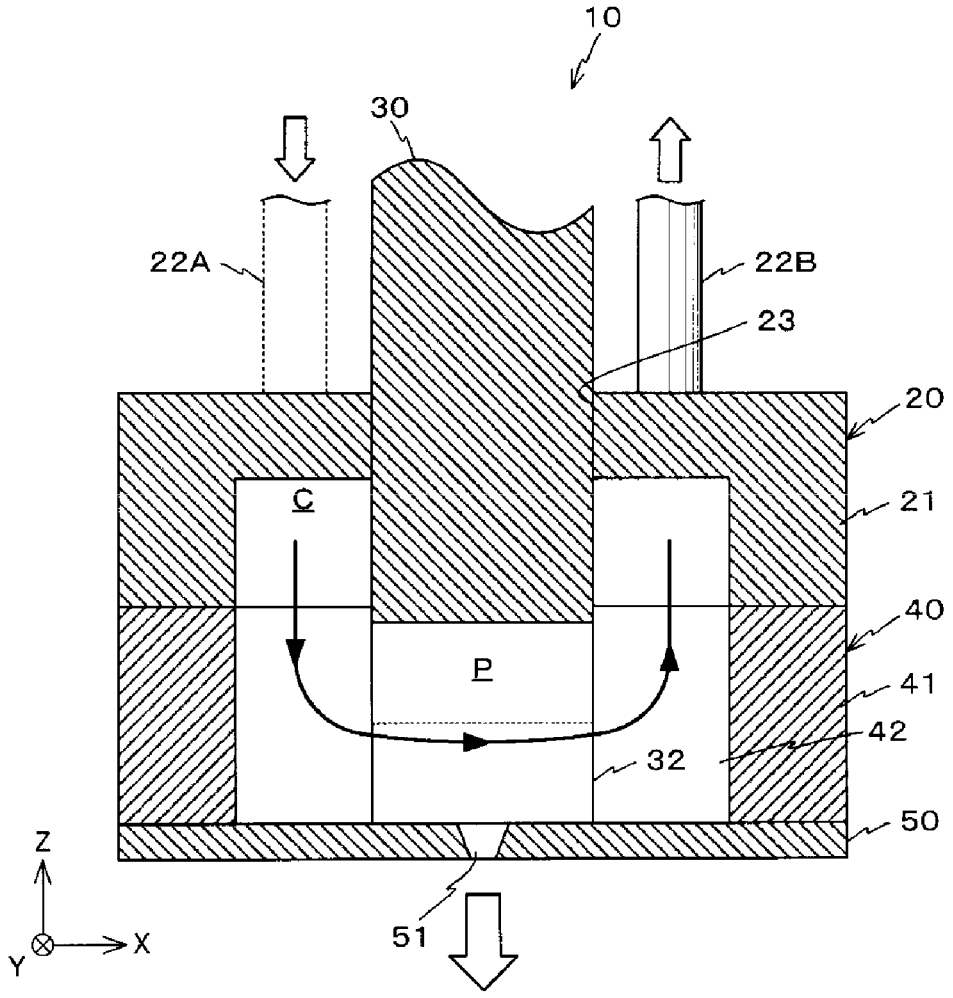
FIG. 10 is an XZ cross-sectional view of an inkjet head according to the first embodiment.

FIG. 10 is an XZ cross-sectional view of the inkjet head 10. As for the casing 20, the substrate 30, the flow passage block 40, and the orifice plate 50 configured as described above, the flow passage block 40 is integrated with the substrate 30 and the actuators 32, as shown in FIG. 10. The substrate 30 is inserted into the opening 23 of the casing 20, and the casing 20 is secured to side surfaces of the substrate 30 and to an upper surface of the flow passage block 40. The internal space of the casing 20 secured to the flow passage block 40 serves as a common ink chamber C fluidly connected with all the pressure chambers P. The orifice plate 50 is secured to a lower surface of the flow passage block 40 and lower surfaces of the actuators 32.

In the inkjet head 10 shown in FIG. 1, the casing 20, the substrate 30, the flow passage block 40, and the orifice plate 50 are assembled. The openings 51 of the orifice plate 50 are fluidly connected with the respective pressure chambers P, as shown in FIG. 9. The dummy chambers D are each hermetically sealed from the ink by the protruding portions 42 of the flow passage block 40 and the orifice plate 50.

As shown in FIG. 10, the ink is supplied from the duct 22A and discharged from the duct 22B, so that the ink circulates in the inkjet head 10. As indicated by the solid line arrows in FIG. 10, in the inkjet head 10, the ink flowing from the duct 22A passes through an interior of the casing 20 and then flows into each pressure chamber P by the flow passage block 40. The ink flowing into the pressure chamber P is directed to the interior of the casing 20 by the flow passage block 40 and discharged from the duct 22B.

When a voltage is applied to the electrode patterns 33 such that certain actuators 32 are selectively driven while the ink is circulating as indicated by the solid line arrows in FIG. 10, the actuators 32 deform from a state shown in FIG. 6 into a state shown in FIG. 7. The spaces S functioning as the pressure chambers P thereby contract, and the ink is ejected from the respective openings 51 in the orifice plate 50 as indicated by the lower outline arrow in FIG. 10.

A method of manufacturing the inkjet head 10 configured as described above will next be described.

Figure 11:
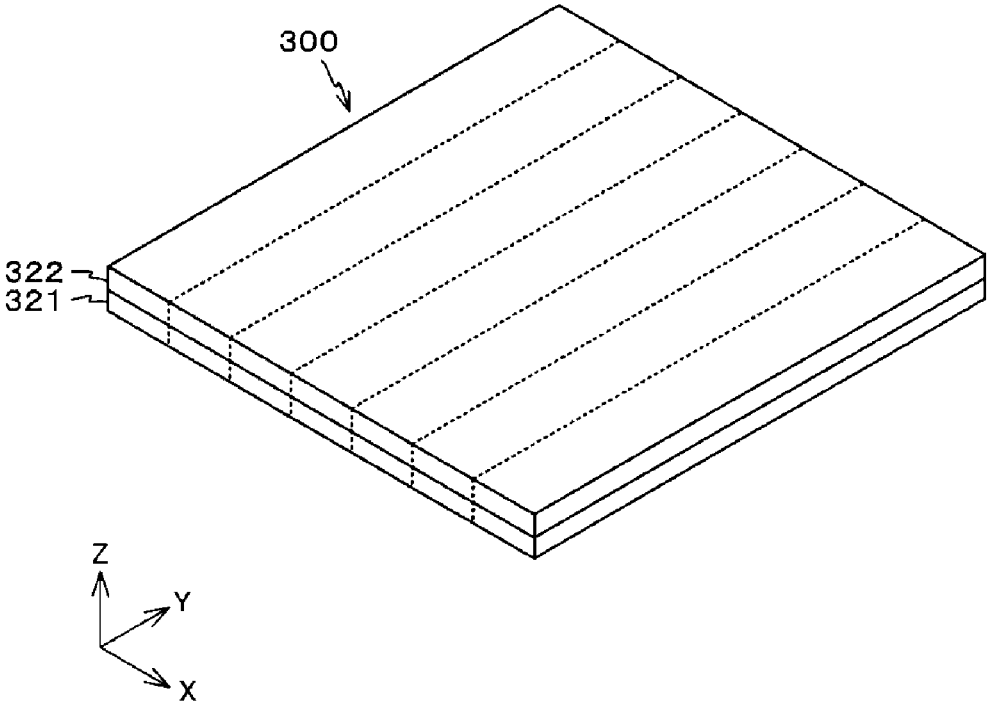
FIGS. 11-18 are an explanatory diagram depicting aspects of a method of manufacturing an inkjet head according to the first embodiment.

First, as shown in FIG. 11, a sheet 321 mainly containing the same lead zirconate titanate as that of the piezoelectric element 32*a* and a sheet 322 mainly containing the same lead zirconate titanate as that of the piezoelectric element 32*b* are bonded together, thereby forming a multilayer film 300 of a two-layer structure. For bonding the sheets 321 and 322 together, thermosetting adhesive, for example, can be used.

A direction of polarization of each of the sheets 321 and 322 of the multilayer film 300 is a direction parallel to a thickness of the sheets 321 and 322 in the Z-axis direction. In the first embodiment, for example, a polarity of the sheet 321 is in a +Z direction and a polarity of the sheet 322 is in a −Z direction.

Figure 12:
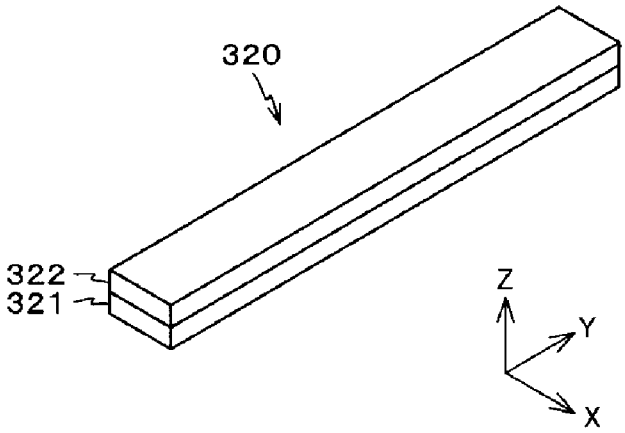

Next, the multilayer film 300 is cut into strips at positions indicated by the dotted lines in FIG. 11. As shown in FIG. 12, a sheet block 320 having the two sheets 321 and 322 and extending in the Y-axis direction is thereby formed.

Figure 13:
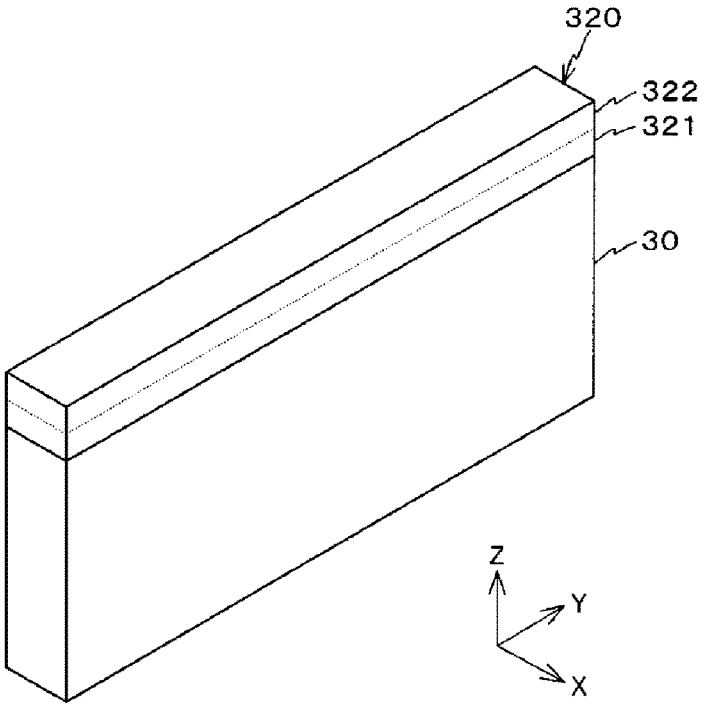

Next, as shown in FIG. 13, the sheet block 320 is adhesively bonded to an upper surface of the substrate 30 by using, for example, thermosetting adhesive or ultraviolet curable adhesive.

Figure 14:
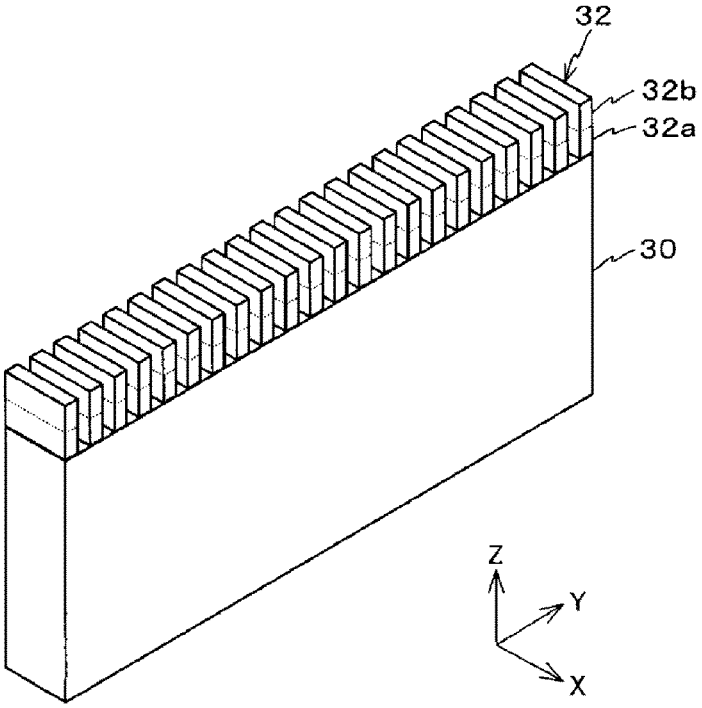

Using a diamond saw, a plurality of grooves are formed in the sheet block 320 such that the grooves start from an upper surface of the sheet block 320 to reach the substrate 30 and are parallel to the X-axis. As shown in FIG. 14, the sheets 321 and 322 of the sheet block 320 are thereby formed into the piezoelectric elements 32*a* and 32*b*, respectively. A pair of piezoelectric elements 32*a* and 32*b* constitutes an actuator 32. When the actuators 32 are formed using the diamond saw, the surface of the substrate 30 between the actuators 32 becomes a recess surface as shown in FIG. 4.

Figure 15:
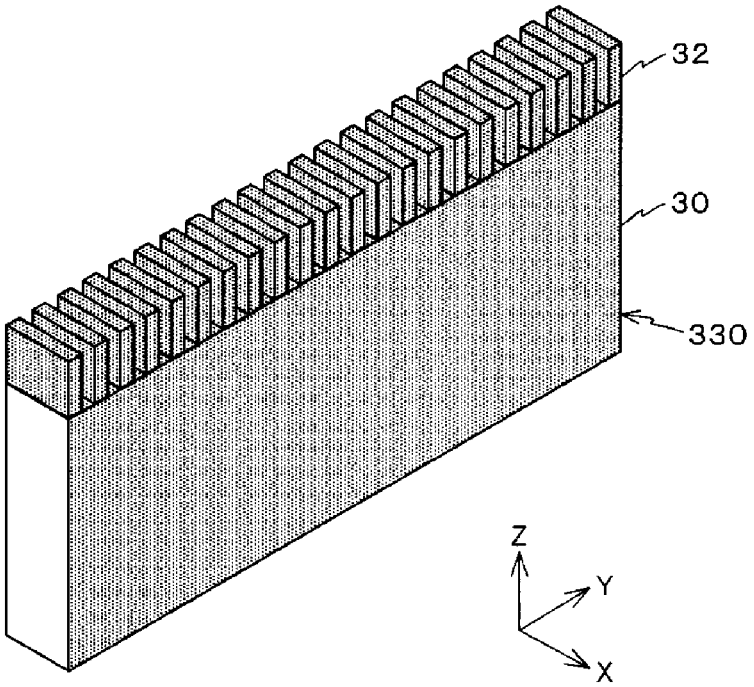

Next, as shown in FIG. 15, a plated film 330, for example, is formed on surfaces of the actuators 32 and the +X-side surface of the substrate 30. The upper surfaces on the +Z-side of the actuators 32 and side surfaces on the +X-side and −X-side of the actuators 32 are polished and the plated film 330 is removed on the actuators 32 by patterning process of the plated film 330 on the substrate 30. The electrode patterns 33 for applying the voltage to the actuators 32 are thereby formed, as shown in FIG. 5.

Figure 16:
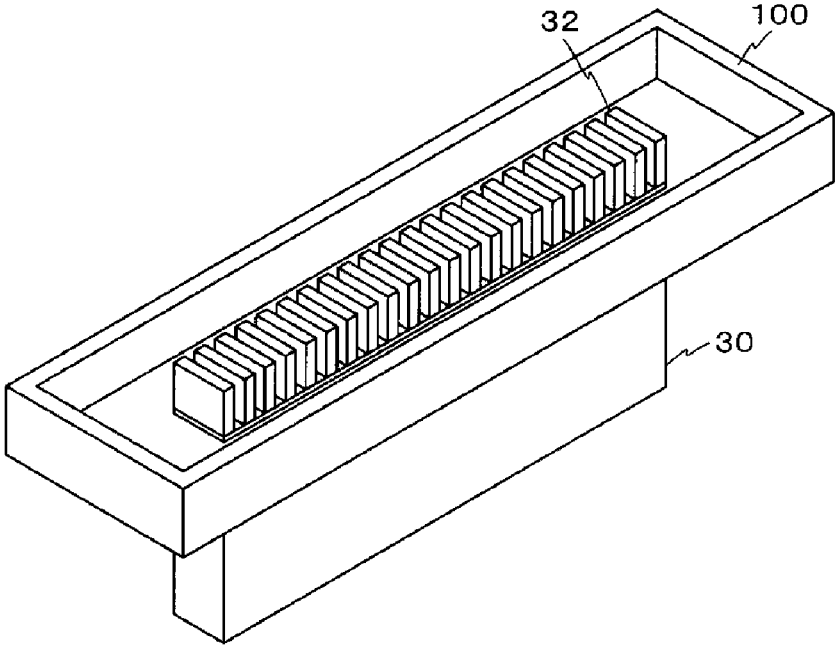

Next, as shown in FIG. 16, a framework 100 is provided for the substrate 30 as to expose upper ends of the actuators 32 and the substrate 30.

Figure 17:
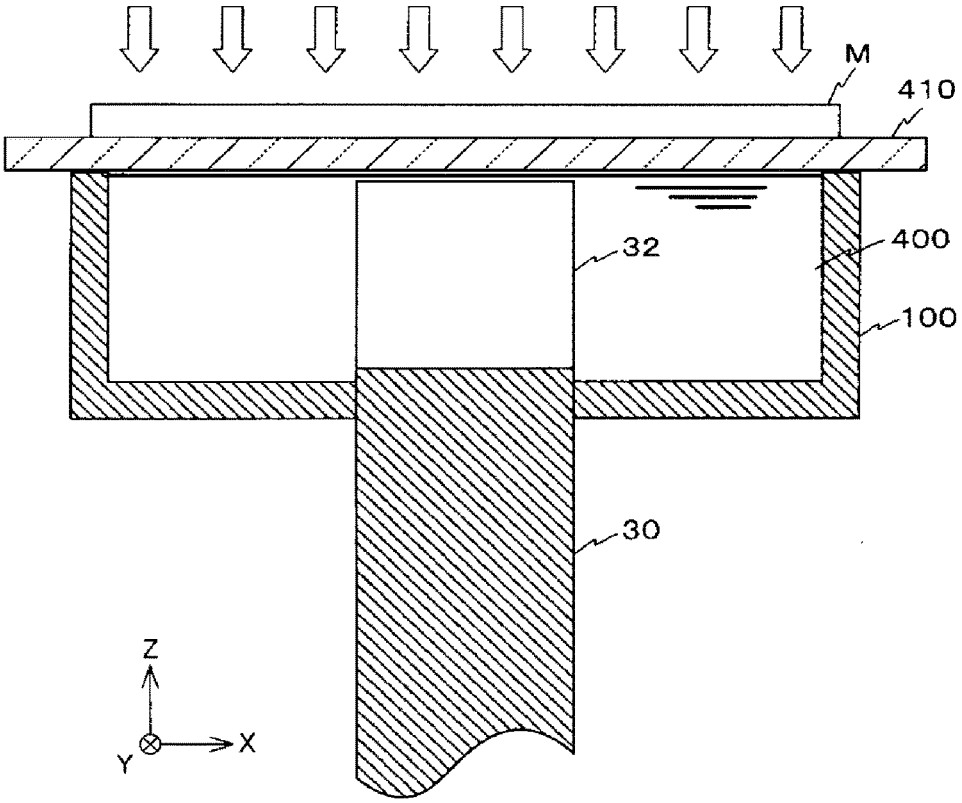
Figure 18:
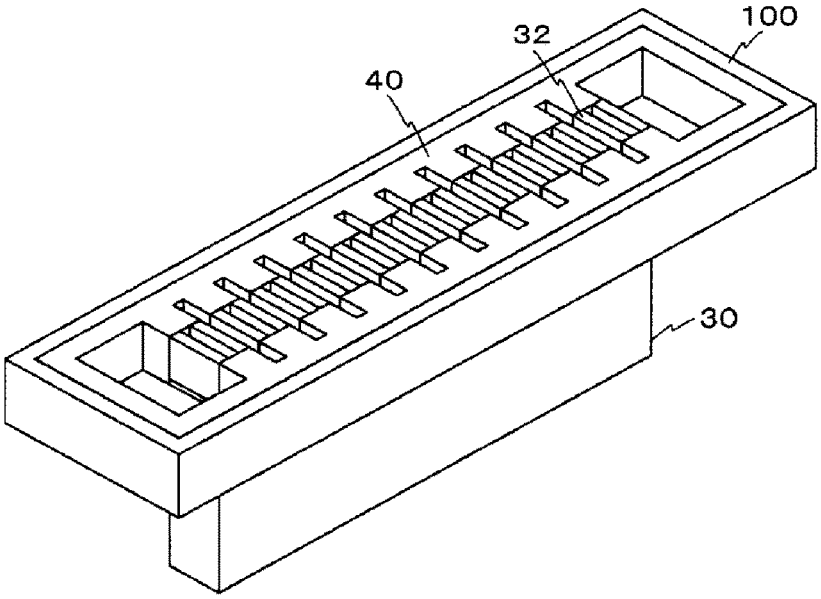

Next, as shown in FIG. 17, an ultraviolet curable resin 400 cured by ultraviolet light is filled into the framework 100 and the framework 100 is covered with a plate 410 such as a glass plate transmitting the ultraviolet light. The ultraviolet curable resin 400 is irradiated with the ultraviolet light via a mask M, thereby curing the ultraviolet curable resin 400. The flow passage block 40 made of the ultraviolet curable resin 400 is thereby formed, as shown in FIG. 18.

Next, the framework 100 and the uncured ultraviolet curable resin 400 are removed. The flow passage block 40 integrated with the substrate 30 and the actuators 32 is thereby formed, as shown in FIG. 8. Upon formation of the flow passage block 40, the surface of the flow passage block 40 as well as the surfaces of the actuators 32 is polished. The ultraviolet curable resin remaining on the surfaces of the actuators 32 is thereby removed and the surfaces of the actuators 32 onto which the orifice plate 50 is adhesively bonded are thereby flattened.

Next, as shown in FIG. 2, the casing 20 is secured to the substrate 30 and the flow passage block 40, and the orifice plate 50 is secured to the flow passage block 40. The inkjet head 10 is thereby completed.

In the inkjet head 10 manufactured through the processes described above, a driver IC (not shown) is connected to the electrode patterns 33 and the ink circulation system is connected to the ducts 22A and 22B.

As described above, according to the first embodiment, the protruding portions 42 of the flow passage block 40 hermetically seal the spaces S formed between adjacent actuators 32, thereby forming the dummy chambers D as shown in FIG. 9. In the flow passage block 40, the flow passage F of the ink circulating in each pressure chamber P is formed between a pair of facing protruding portions 42. The protruding portions 42 are integrated with the frame portion 41 to constitute the flow passage block 40. Thus, hermetically sealing the spaces S between two adjacent actuators 32 to provide the dummy chambers D can eliminate difficult work including filling resin between adjacent actuators 32 one pair at a time. Therefore, it is possible to easily manufacture an inkjet head 10 having dummy chambers.

The method of manufacturing an inkjet head 10 according to the first embodiment can reduce a manufacturing cost of an inkjet head 10 having dummy chambers and improve manufacturing yield.

Figure 19:
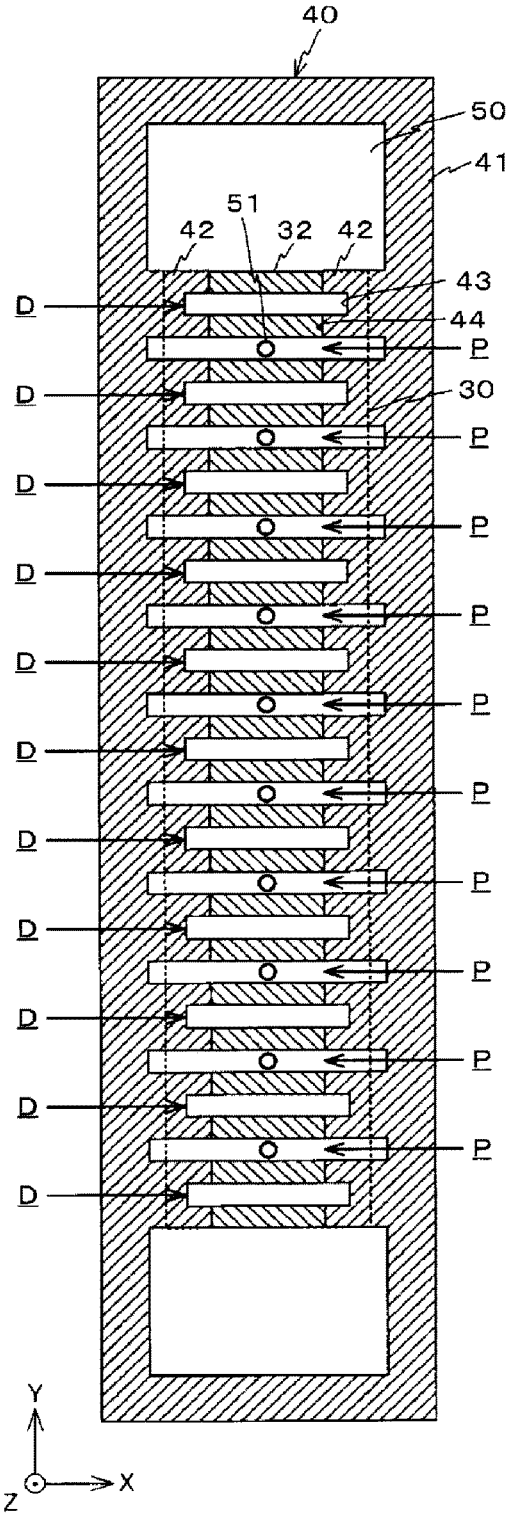
FIG. 19 depicts aspects of an inkjet head according to a modification of the first embodiment.

In the first embodiment, abutment surfaces of the protruding portions 42 abutting on the two adjacent actuators 32 are flat, as shown in FIG. 9. However, the disclosure is not limited to this example embodiment. For example, as shown in FIG. 19, recess portions 43 may be formed on surfaces of a pair of facing protruding portions 42, and a pair of support portions 44 interposing the recess portions 43 may support the actuator 32. The support portions 44 are elastic and can deform freely. This can reduce a resistance when the actuators 32 are driven, so that a lower voltage can be applied to the actuators 32. Therefore, it is possible to reduce electric power consumed by the inkjet head 10.

When the support portions 44 support the actuators 32 as shown in FIG. 19, the length of each dummy chamber D in the X-axis direction is larger than the dimension of each actuator 32 in the X-axis direction. For this reason, it is necessary to set the thickness of the substrate 30 to be larger than the length of each actuator 32 in the X-axis direction.

Figure 20:
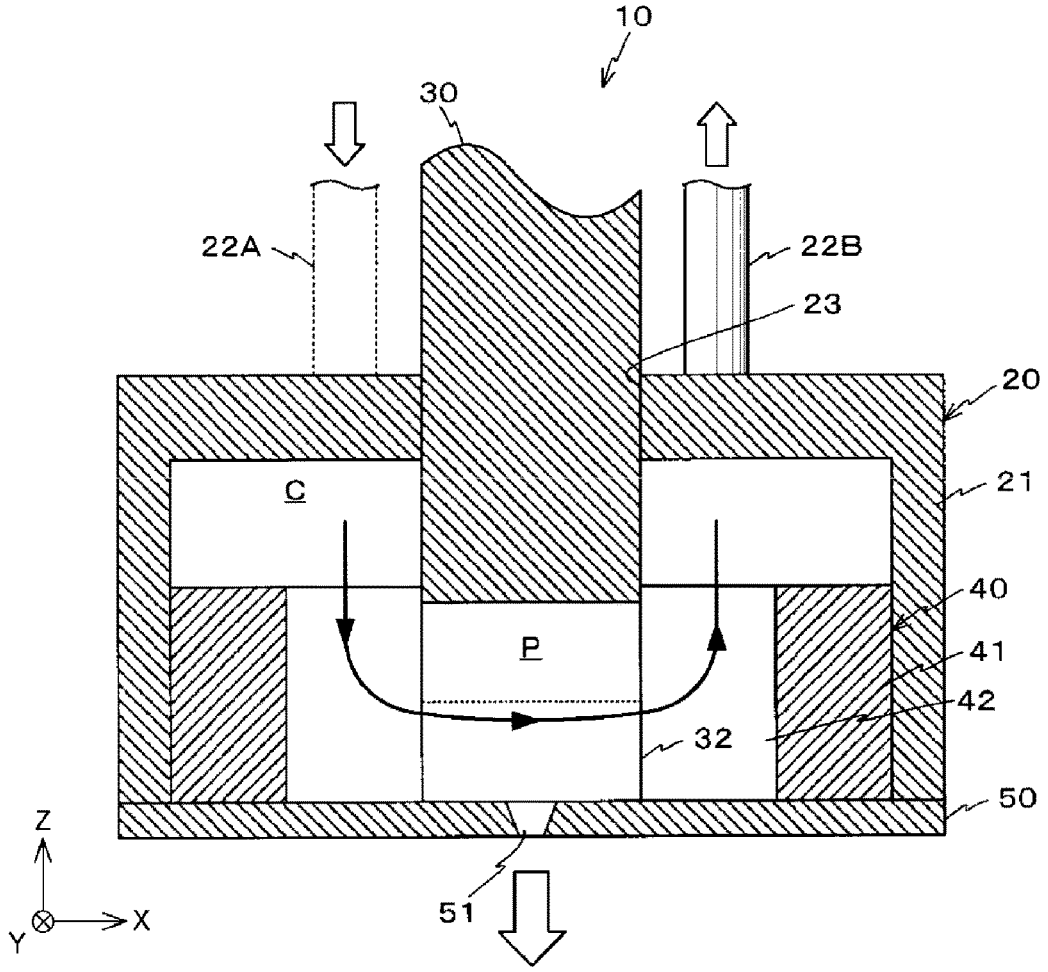
FIG. 20 depicts aspects of an inkjet head according to a modification of the first embodiment.

In the first embodiment, the upper surface of the flow passage block 40 is adhesively bonded to a lower surface of the casing 20 as shown in FIG. 10. However, the disclosure is not limited to this example embodiment. As shown in FIG. 20, the flow passage block 40 may be surrounded by the casing 20.

Figure 21:
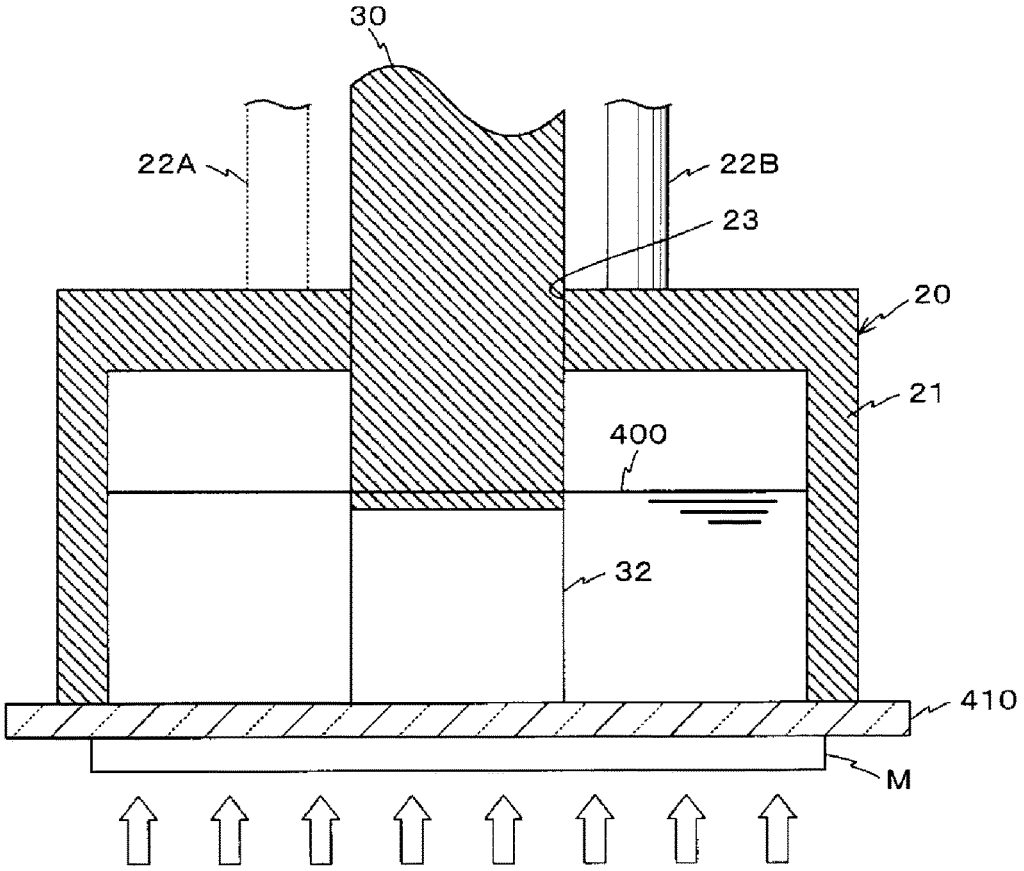
FIG. 21 is an explanatory diagram of a method of manufacturing the inkjet head according to the modification shown in FIG. 20.

In this case, a length of the inkjet head 10 in the X-axis direction becomes larger. However, it is possible to simplify manufacturing processes of the inkjet head 10. For example, as shown in FIG. 21, the casing 20 is secured to the substrate 30 and the lower surface of the casing 20 is then covered with the plate 410 such as the glass plate transmitting the ultraviolet light. Next, the ultraviolet curable resin 400 is filled into the casing 20 and is irradiated with the ultraviolet light via the mask M. It is thereby possible to form the flow passage block 40 integrated with the casing 20 and the substrate 30. With this method, it is possible to form the flow passage block 40 without using the framework 100. It is, therefore, possible to reduce the manufacturing cost of the inkjet head 10.

Second Embodiment

A second embodiment will next be described with reference to the drawings. Substantially similar elements according to the second embodiment are denoted by the same reference numerals as those according to the first, and a detailed description of these elements will be omitted.

Figure 22:
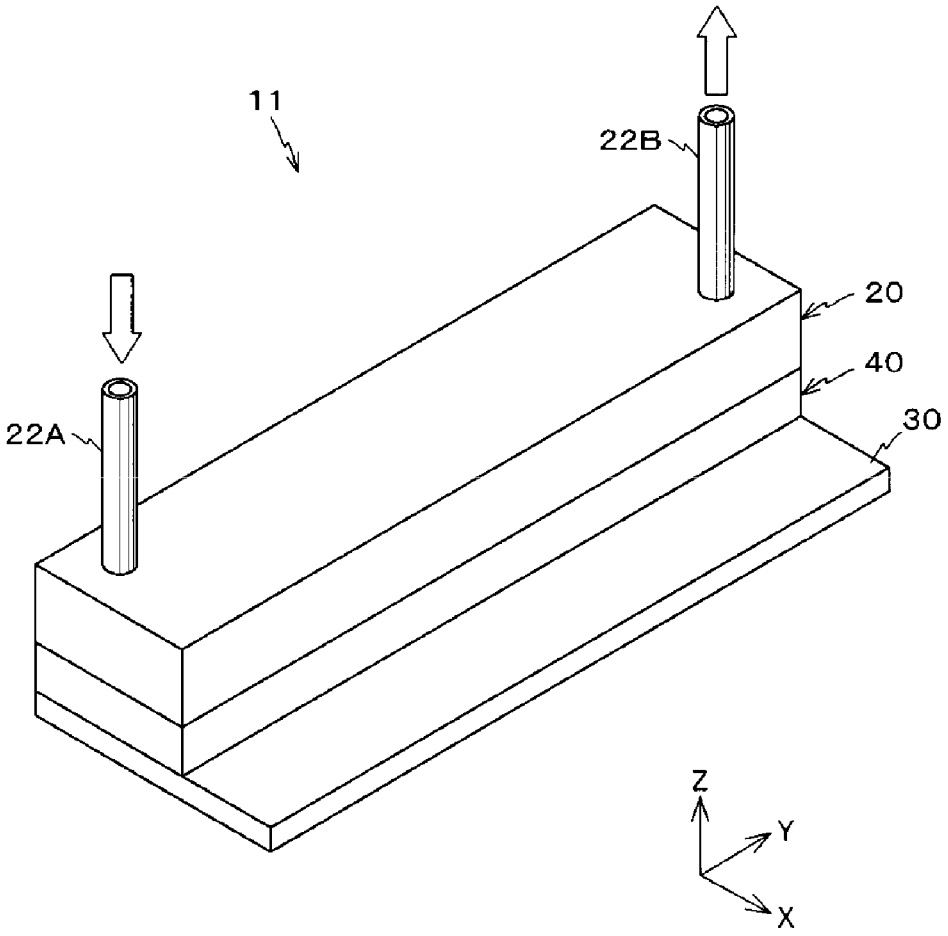
FIG. 22 is a perspective view of an inkjet head according to a second embodiment.

FIG. 22 is a perspective view of an inkjet head 11 according to the second embodiment. The inkjet head 11 according to the second embodiment differs from the inkjet head 10 according to the first embodiment in that the substrate 30 also serves as the orifice plate 50.

Figure 23:
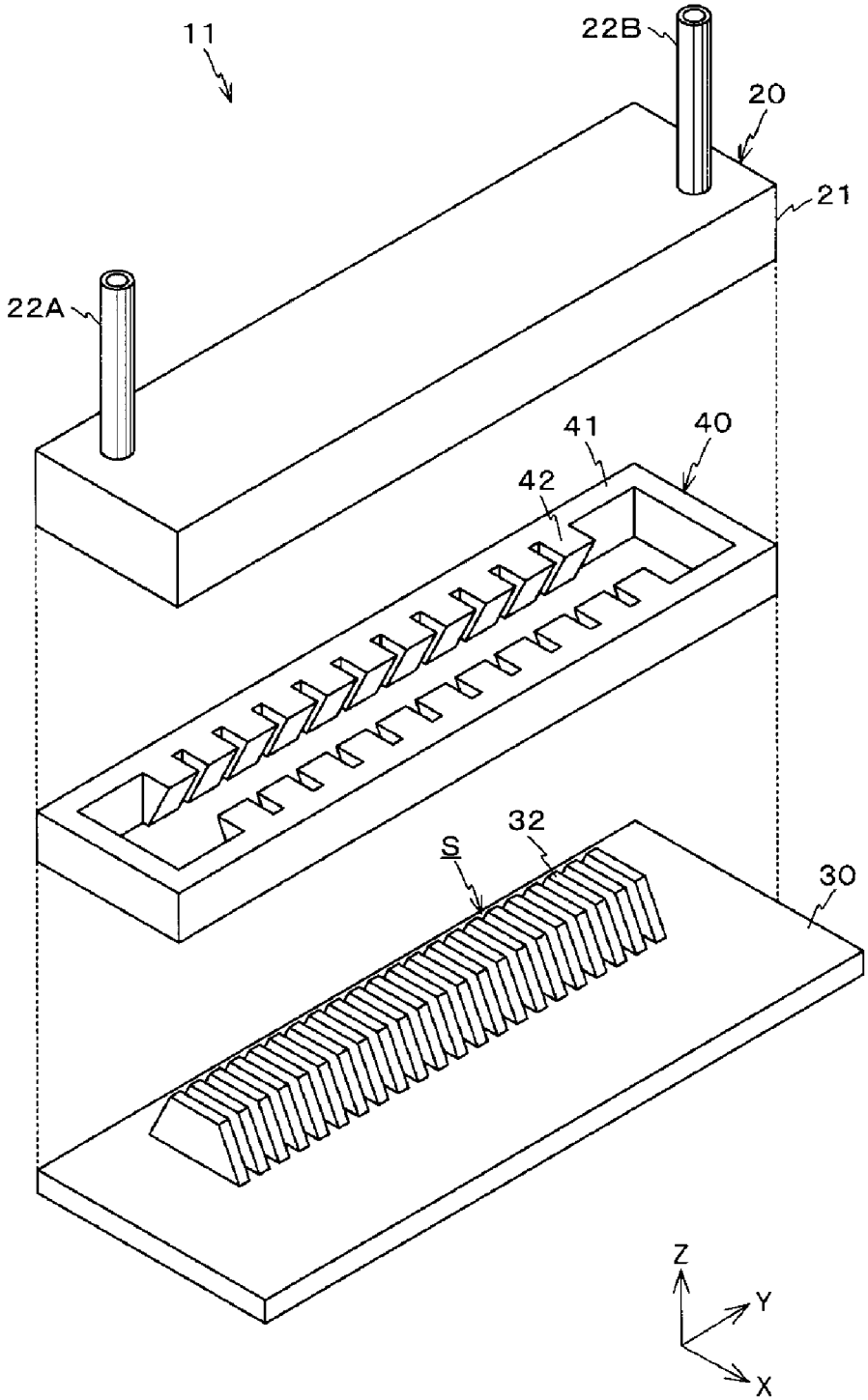
FIG. 23 is an exploded perspective view of an inkjet head according to the second embodiment.

FIG. 23 is an exploded perspective view of the inkjet head 11. As shown in FIG. 23, the substrate 30 also serves as the orifice plate and extends in the Y-axis direction. The actuators 32 formed into trapezoidal shapes along a −X-side outer edge of the substrate 30 on the upper surface thereof are disposed at equidistant intervals. Electrode patterns for applying the voltage to each actuator 32 are formed on the upper surface of the substrate 30 to connect the actuator 32 and an +X-side end of the substrate 30.

The flow passage block 40 is secured to the upper surface of the substrate 30 to surround the actuators 32. The casing 20 is then secured to the flow passage block 40.

Figure 24:
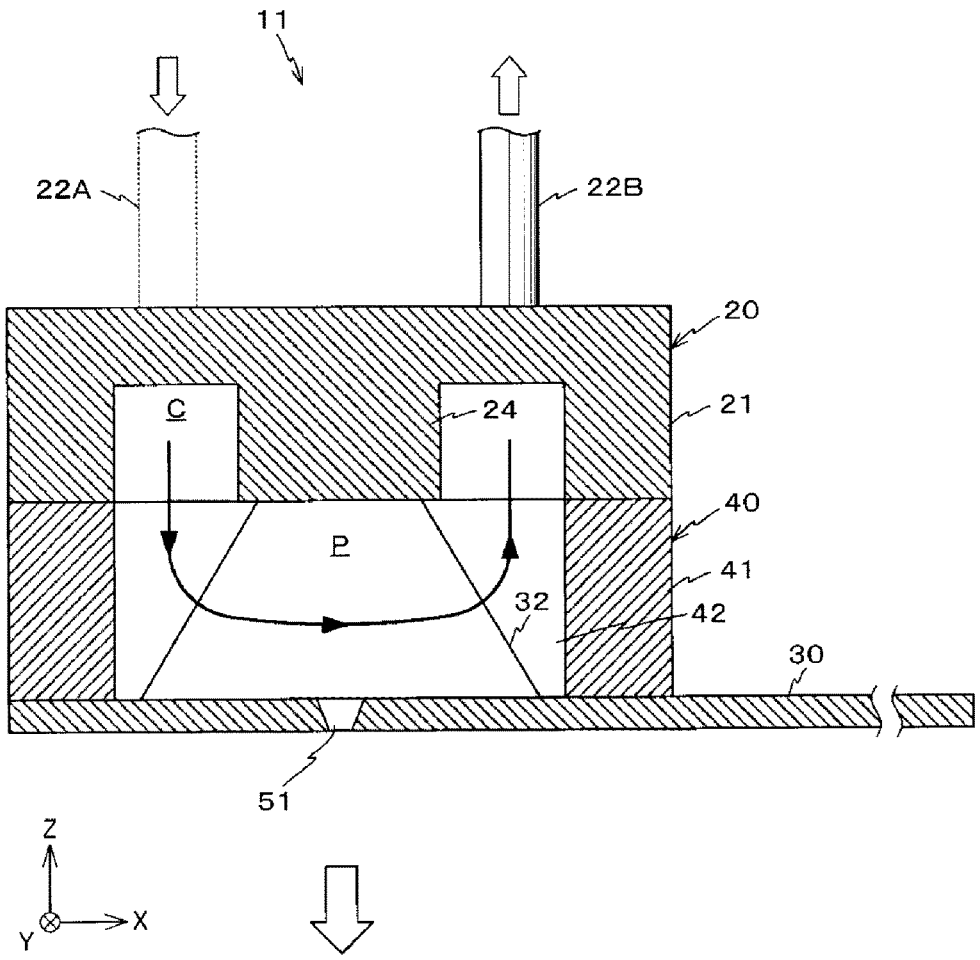
FIG. 24 is an explanatory diagram of an action performed by an inkjet head according to the second embodiment.

FIG. 24 is an XZ cross-sectional view of the inkjet head 11. As shown in FIG. 24, a projecting portion 24 protruding downward from a central portion of a ceiling surface of the casing 20 is formed within the casing 20. A lower surface of the projecting portion 24 is adhesively bonded to the upper surface of each actuator 32 and a space around the projecting portion 24 functions as the common ink chamber C.

The spaces S between two adjacent actuators 32 alternately serve as the pressure chambers P and the dummy chambers D. Each of the pressure chambers P is a space surrounded by the substrate 30, the actuators 32, and the projecting portion 24 of the casing 20. Each of the dummy chambers D is a space surrounded by the substrate 30, the actuators 32, the projecting portion 24 of the casing 20, and the protruding portions 42 of the flow passage block 40.

As shown in FIG. 24, the ink is supplied from the duct 22A and the ink is discharged from the duct 22B, so that the ink circulates in the inkjet head 11. As indicated by the solid line arrows in FIG. 24, in the inkjet head 11, the ink flowing from the duct 22A passes through the interior of the casing 20 and then flows into each pressure chamber P by the flow passage block 40. The ink flowing into the pressure chamber P is directed to the interior of the casing 20 by the flow passage block 40 and discharged from the duct 22B.

When the actuators 32 are driven while the ink is circulating as indicated by the solid line arrows in FIG. 24, the ink is ejected from respective openings 51 in the substrate 30 as indicated by the lower outline arrow.

As described above, according to the second embodiment, the protruding portions 42 of the flow passage block 40 hermetically seal the spaces S formed between adjacent actuators 32, thereby forming the dummy chambers D. In the flow passage block 40, the flow passage of the ink circulating in each pressure chamber P is formed between a pair of facing protruding portions 42. The protruding portions 42 are integrated with the frame portion 41 to constitute the flow passage block 40. Thus, hermetically sealing the spaces S between two adjacent actuators 32 to provide the dummy chambers D can eliminate with difficult work including filling resin between adjacent actuators 32 one pair at a time. Therefore, it is possible to easily manufacture an inkjet head 11 having dummy chambers.

While the embodiments of the present disclosure are described so far, the present disclosure is not limited by the example embodiments described above. For example, in the example embodiments, the flow passage block 40 is manufactured using the ultraviolet curable resin 400. However, the present disclosure is not limited to this example. The flow passage block 40 may be configured from a resin other than the ultraviolet curable resin 400.

In the example embodiments described above, the pressure chambers P and the dummy chambers D are alternately disposed. However, the pressure chambers P and the dummy chambers D may not necessarily alternately be disposed.

The inkjet heads 10 and 11 according to the first and second embodiments are presented by way of example only, and the number and dimensions of the actuators 32 provided on the substrate 30, the number and dimensions of the pressure chambers P and the dummy chambers D, and the like can be changed, as appropriate, depending on uses and/or resolutions of the inkjet heads 10 and 11.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. The accompanying claims and their equivalents are intended to cover such forms or modifications as would fall within the scope and spirit of the inventions.

What is claimed is:

1. An inkjet head comprising:

a plurality of actuators on a substrate in a row and spaced from each other, each actuator extending from the substrate to form a chamber space between each adjacent pair of actuators in the plurality of actuators;

a flow passage block including a frame portion surrounding an outer periphery of the plurality of actuators and a blocking portion having protrusions sealing both ends of the chamber spaces between every other adjacent pair of actuators along the row; and a common ink chamber above the flow passage block and in fluid communication with the chamber spaces between any adjacent pairs of actuators not sealed at both ends by the blocking portion with a plurality of pressure chambers.

2. The inkjet head according to claim 1, wherein the flow passage block is formed from a photosensitive resin.

3. The inkjet head according to claim 1, wherein at least one protrusion of the blocking portion includes a pair of support portions supporting an adjacent pair of actuators, and a recess is between the pair of support portions.

4. The inkjet head according to claim 1, further comprising:

a casing on the substrate enclosing the common ink chamber and the flow passage block.

5. The inkjet head according to claim 1, further comprising:

an orifice plate on the substrate and having a plurality of nozzles in fluid communication with the common ink chamber.

6. The inkjet head according to claim 1, wherein a plurality of nozzles is formed in the substrate and in fluid communication with the common ink chamber.

7. The inkjet head according to claim 1, wherein the chamber spaces between adjacent pairs of actuators alternate along the row between a first width, in a row direction, and a second width, in the row direction, the first and second widths being different from each other.

8. A method of manufacturing an inkjet head, comprising:

forming a plurality of actuators on a substrate in a row and spaced from each other, each actuator extending from the substrate to form a chamber space between each adjacent pair of actuators in the plurality of actuators;

placing a frame around an outer periphery of the plurality of actuators;

filling a photosensitive resin into the frame; and curing the photosensitive resin to form a flow passage block including a frame portion surrounding the outer periphery of the plurality of actuators and a blocking portion, the blocking portion having protrusions sealing both ends of the chamber spaces between every other adjacent pair of actuators along the row.

9. The method according to claim 8, further comprising:

removing cured portions of the photosensitive resin from the frame portion outside the blocking portion.

10. The method according to claim 8, further comprising:

attaching a casing to the substrate to enclose a common ink chamber and the flow passage block.

11. The method according to claim 10, wherein the common ink chamber is in fluid communication with chamber spaces between adjacent pairs of actuators not sealed by the blocking portion.

12. The method according to claim 11, further comprising:

attaching an orifice plate to the substrate.

13. The method according to claim 11, further comprising:

forming a plurality of nozzles in the substrate.

14. The method according to claim 8, further comprising:

forming a pair of support portions supporting an adjacent pair of actuators on at least one protrusion of the blocking portion; and forming a recess between the pair of support portions.

15. An inkjet printer comprising a sheet feeder configured to feed a sheet on which an image can be recorded;

a plurality of actuators on a substrate in a row and spaced from each other, each actuator extending from the substrate to form a chamber space between each adjacent pair of actuators in the plurality of actuators;

a flow passage block including a frame portion surrounding an outer periphery of the plurality of actuators and a blocking portion having protrusions sealing both ends of the chamber spaces between every other adjacent pair of actuators along the row;

a common ink chamber above the flow passage block and in fluid communication with the chamber spaces between any adjacent pairs of actuators not sealed at both ends by the blocking portion with a plurality of pressure chambers; and an ink storage container fluidly connected to the common ink chamber and from which ink is supplied to the common ink chamber.

16. The inkjet printer according to claim 15, wherein the flow passage block is formed from a photosensitive resin.

17. The inkjet printer according to claim 15, wherein at least one protrusion of the blocking portion includes a pair of support portions supporting an adjacent pair of actuators, and a recess is between the pair of support portions.

18. The inkjet printer according to claim 15, further comprising:

a casing on the substrate enclosing the common ink chamber and the flow passage block.

19. The inkjet printer according to claim 15, further comprising:

an orifice plate on the substrate and having a plurality of nozzles in fluid communication with the common ink chamber.

20. The inkjet printer according to claim 15, wherein the substrate includes a plurality of nozzles in fluid communication with the common ink chamber.

* * * * *